US010279961B2

(12) United States Patent
Greenfield

(10) Patent No.: US 10,279,961 B2
(45) Date of Patent: May 7, 2019

(54) BOTTLE CLOSURE WITH EASY OPEN TABS

(71) Applicant: Brian Greenfield, Quebec (CA)

(72) Inventor: Brian Greenfield, Quebec (CA)

(73) Assignee: Brian Greenfield, Quebec (CA)

( * ) Notice: Subject to any disclaimer, the term of this patent is extended or adjusted under 35 U.S.C. 154(b) by 0 days.

(21) Appl. No.: 14/245,873

(22) Filed: Apr. 4, 2014

(65) Prior Publication Data

US 2015/0102005 A1 Apr. 16, 2015

Related U.S. Application Data

(60) Provisional application No. 61/961,496, filed on Oct. 16, 2013.

(51) Int. Cl.
*B65D 41/00* (2006.01)
*B65D 41/04* (2006.01)

(52) U.S. Cl.
CPC ..... *B65D 41/0485* (2013.01)

(58) Field of Classification Search
CPC B65D 50/067; B65D 50/068; B65D 41/0485; B65D 50/041
USPC ..... 215/295, 329, 328, 256, 252, 238, 230, 215/228; 220/288
See application file for complete search history.

(56) References Cited

U.S. PATENT DOCUMENTS 1,912,969 A * 6/1933 Carvalho ..... 215/302
2,921,705 A * 1/1960 Dorsey ..... 215/215
D202,137 S * 8/1965 Wilson ..... D9/450
3,433,380 A * 3/1969 Kawchitch ..... 215/329
D220,613 S * 5/1971 Beck ..... D9/453
3,850,325 A * 11/1974 MacLeod ..... B65D 50/04 215/218
4,156,491 A * 5/1979 Lyon ..... 215/302
4,252,249 A * 2/1981 Beckhardt et al. ..... 220/284
4,469,235 A * 9/1984 Parker ..... 215/295
4,534,477 A * 8/1985 Laub, III ..... 215/215
4,731,512 A 3/1988 Barriac
D299,699 S * 2/1989 Ask ..... D9/453
5,147,052 A * 9/1992 Minette ..... 215/215
5,429,257 A * 7/1995 Greenfield et al. ..... 215/295
5,595,198 A * 1/1997 Kemmerer ..... A45D 40/265 132/218
5,704,502 A 1/1998 Greenfield
6,648,161 B2 * 11/2003 Vick ..... 220/288
D542,133 S * 5/2007 Haber et al. ..... D9/453
D613,161 S * 4/2010 Greenfield ..... D9/443
D620,356 S * 7/2010 Greenfield ..... D9/443
(Continued)

*Primary Examiner* — Ernesto Grano

(74) *Attorney, Agent, or Firm* — Leason Ellis LLP

(57) ABSTRACT

A cap for a bottle is provided with taps that make it easy for someone with a disability, e.g., arthritis, to twist the cap off of the bottle. The cap can have two or more rectangular vertical tabs arranged along the perimeter of the top surface of the cap so as to face each other in parallel on opposite sides of the top surface of the cap. The tabs have an extended height, i.e., greater than ¼th inch and are separated by a distance approximately equal to the diameter of the top surface of the cap. The top corners of the tabs are squared (90 degree angles) to provide better gripping of a corner against which the tabs are placed while twisting the bottle so as to cause the cap to be released from the bottle.

6 Claims, 8 Drawing Sheets

(56) References Cited

U.S. PATENT DOCUMENTS

| | | | | |
|---|---|---|---|---|
| D633,808 | S * | 3/2011 | Titherington | B65D 50/041 D9/453 |
| 8,322,548 | B2 * | 12/2012 | Pedersen | 215/302 |
| 2007/0045219 | A1 * | 3/2007 | Nasiatka | 215/302 |
| 2012/0152882 | A1 * | 6/2012 | Tune | B65D 1/0223 215/40 |

* cited by examiner

BOTTLE CLOSURE WITH EASY OPEN TABS

CROSS-REFERENCE TO RELATED APPLICATIONS

This patent application is a conversion of and claims priority to U.S. Provisional Patent Application Ser. No. 61/961,496, filed Oct. 16, 2013, the entire contents of which are incorporated by reference in its respective entirety.

TECHNICAL FIELD

The present invention is generally directed to a closure for a bottle, e.g., a cap, that is designed to make the opening of the closure easier for people whose physical condition makes the normal opening of the bottle difficult.

BACKGROUND OF THE INVENTION

It is well known that many individuals experience weakness or pain in their hands, especially those suffering from arthritis. Those individuals find it challenging to grasp and twist standard twist and turn caps due to their impairments, and often require assistance in accessing the contents of a bottle, e.g., prescription medicines. This is an especially troubling problem because arthritics consume over 30% of prescription products yearly.

Caps have been proposed in the past which include upstanding tabs that are intended to engage furniture or walls in order to assist in turning the caps to open the container. As an example, U.S. Pat. No. 4,731,512 of Barriac discloses various upstanding tabs useful in twisting the cap to allow access to the contents of the bottle. However, it turns out that the height of Barriac's tabs is too low to effectively engage a corner (e.g., the edge of a table, a corner of a door frame or a shelf of a bookcase) in order for an impaired user to comfortably twist the cap. This height is about the thickness of a pencil or ¼ inch. Also, some of the Barriac tabs have shallow "v"-shapes, which make them even less effective in grasping a corner surface. In particular, the "v"-shape slips too easily from the corner instead of grabbing the corner surface. The same is true of the Barriac tabs oriented as spokes on a wheel. The spokes only offer two closely spaced grabbing tabs at any one time, and that does not provide sufficient stability to grab and torque off a cap. Also, the way all the spoked tabs are configured on the same surface at the same time, would interfere with grabbing. Barriac's tabs on the top surface are all oriented to the midline, limiting the torque that can be generated.

The present inventor's own U.S. Pat. No. 5,429,257 also discloses shallow vertical tabs intended to engage the forearm of the user. While these tabs are not oriented toward the midline of the cap and have generally rectangular shape, they tend to dig into the forearm of the user while the user is trying to twist off the cap. This cause discomfort and even pain. Further, because the flesh of the forearm tends to give under pressure, a reduced amount of torque is applied to the cap. Also, the present inventor's own U.S. Pat. No. 5,704,502 discloses a variety of upstanding tabs designed to engage the forearm, fingers, palm or wrist of the user. Some of these tabs may be pivoted down so as to be flush with the top surface of the cap. As with U.S. Pat. No. 5,429,257, the tabs of this design are uncomfortable to use and provide reduced torque.

The present inventor also has U.S. Design Pat. Nos. D613,161 and D620,356, which disclose upstanding tabs of significant height, i.e., above ¼ inch. However, each has a rounded profile. When the tabs engage a corner, the maximum torque is generated at the ends of the tabs. However, with these rounded designs the ends of the tabs have reduced heights. Thus, they are not very effective in transmitting torque to the cap to twist it off the bottle. In particular, those rounded ends do not provide extensive solid contact surfaces when engaging the corner surface of a structure while torqueing the cap loose.

From the above, it can therefore be seen that there exists a need in the art to overcome the deficiencies and limitations of the prior art and to provide tabs on a cap that make it easy to twist because it is not uncomfortable to use and transmits significant torque to the cap.

SUMMARY OF THE INVENTION

In order to solve the problems of the prior art, there is provided a closure that permits the user to loosen a cap without directly touching it. The user simply holds the bottle with the attached cap of the present invention and pushes the bottle toward a corner surface, e.g., the corner of furniture, so that the tabs of the cap engage the corner. Then the user twists the bottle so as to leverage the tabs against that corner sufficiently to generate enough torque to loosen the cap.

The cap is characterized by two rectangular vertical tabs arranged in parallel along the perimeter, and facing each other on opposite sides of the top surface of the cap. The tabs are each over ¼ inches in height and have sufficient distance between them to promote gripping of a corner surface of a wall or furniture. When engaged with the corner surface the tabs generally make four points of contact (both ends of the top square surface of the tabs), which are vertical and do not slip off the corner because they are tall enough (i.e., over ¼ inches).

This concept is useful for arthritic patients opening simple caps, but can also be used on child resistant caps. Thus it can be marketed not only in the pharmaceutical industry (requiring only a 10% child resistant format), but also in the cosmetic and food industry, where child resistant caps have little to no application. To accomplish this, the present invention does not need to engage the child resistant component of an inner cap that creates the child resistant feature.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

FIGS. 1-4 illustrate a rectangular bottle 10 whose opening is closed by a circular cap 11. However, the bottle may have a different shape, e.g., it may be a cylindrical bottle. Further, while the cap is shown as having a round shape it may have a square, rectangular or other shape, just so long as it engages and disengages the bottle by a twisting motion.

The cap is characterized by two rectangular vertical tabs 16 arranged along the perimeter of the top surface 12 of the cap. The tabs 16 face each other in parallel on opposite sides of the top surface 12 of the cap. The tabs have an extended height, i.e., greater than $\frac{1}{4}^{th}$ inch. For example, each may measure approximately $\frac{3}{8}^{th}$ inch in height or ½ inch in height. In addition, the tabs may be $\frac{7}{8}^{th}$ inch in length and have a thickness at their thickest point of $\frac{1}{8}^{th}$ inch. The two tabs are separated by a distance approximately equal to the diameter of the top surface of the cap. In an example the distance is 1¼ inches on the surface of the cap. See FIG. 4. Naturally, the available separation distance will depend on the size of the cap. In some embodiments where the cap is large the tabs can be set in from the perimeter of the top surface of the cap and still provide sufficient torque.

Figure 4:
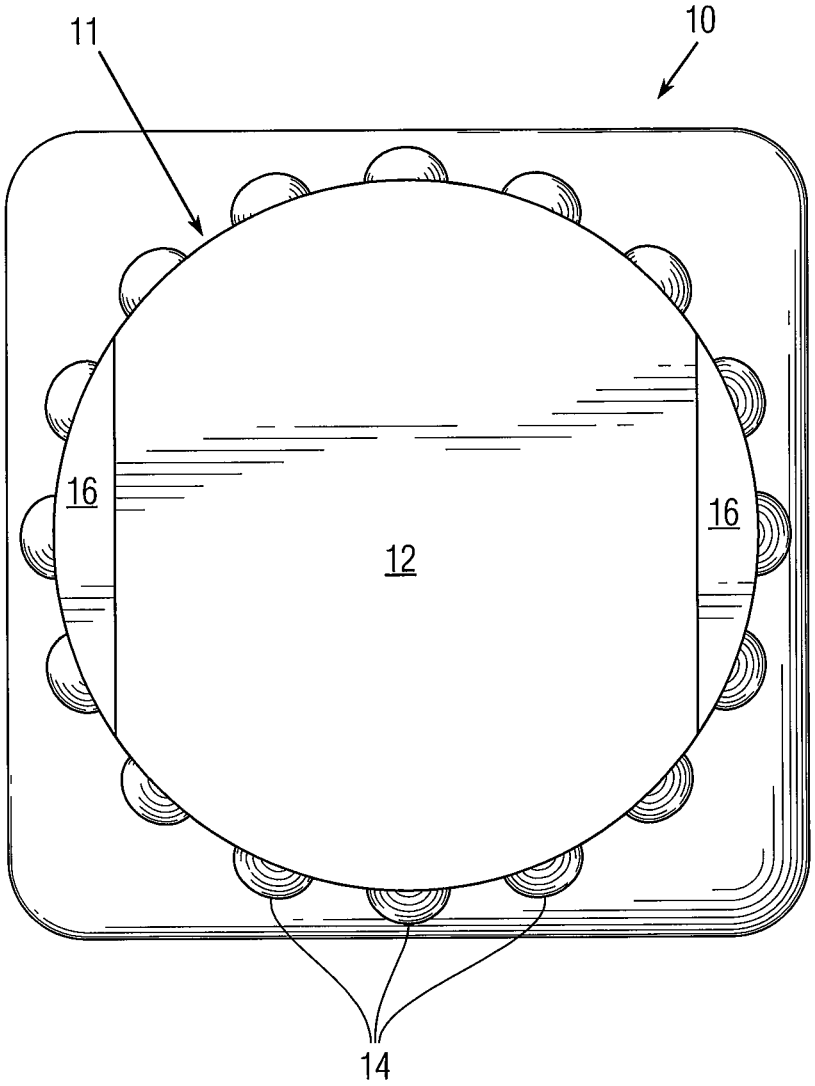
FIG. 4 is a top view of the cap of the present invention.

As shown in FIG. 4, the outer surfaces of the tabs may take on the shape of the cap, i.e., circular, and the inner surfaces are flat planar surfaces to provide maximum contact with the corner. However, the outer surfaces need not follow the shape of the cap and can, for example, also be flat planar surfaces. In addition, while a flat surface is preferred for the inner surface so as to distribute the torque load over the body of the tabs, they can also be curved like the outer surfaces. In such a case the torque is concentrated at the ends of the tabs.

Figure 1:
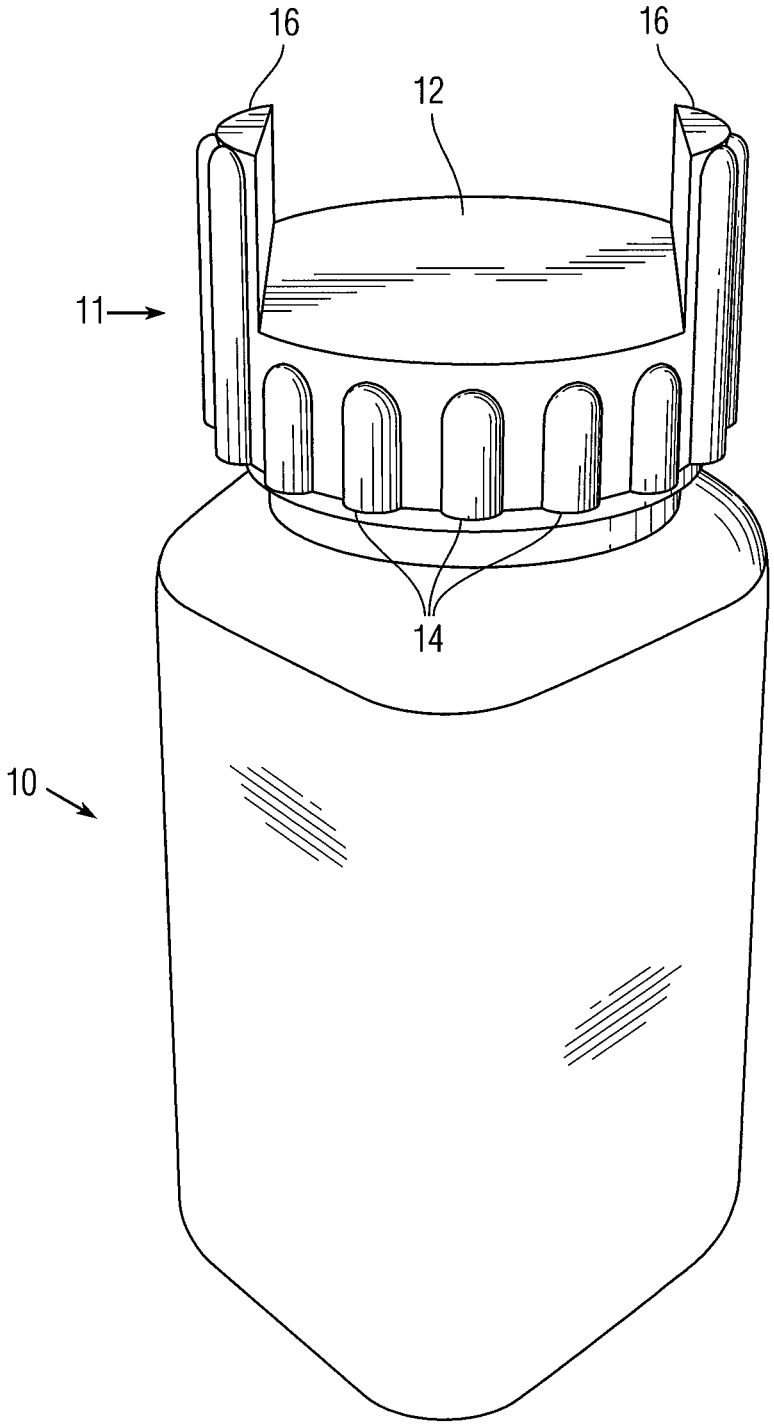
FIG. 1 is a top perspective view of the cap of the present invention mounted on a rectangular bottle.
Figure 2:
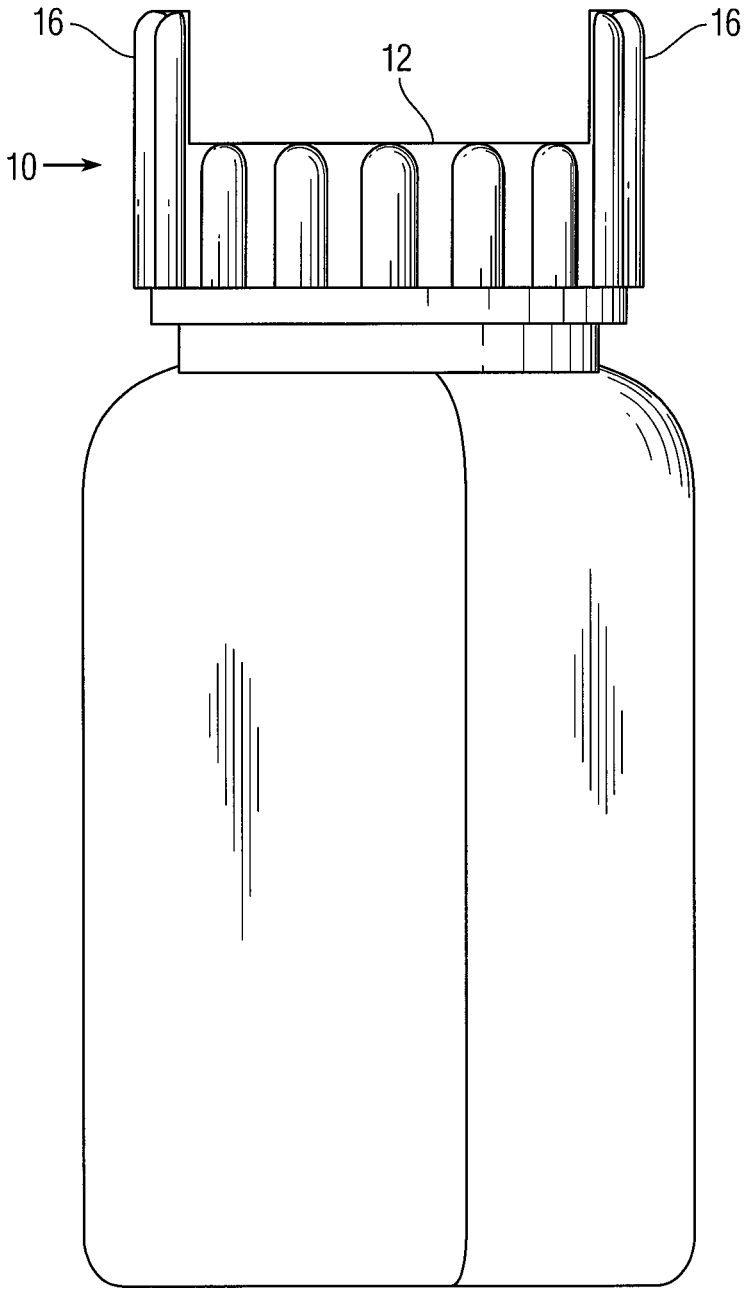
FIG. 2 is a front elevation view of the cap of the present invention mounted on a rectangular bottle.
Figure 3:
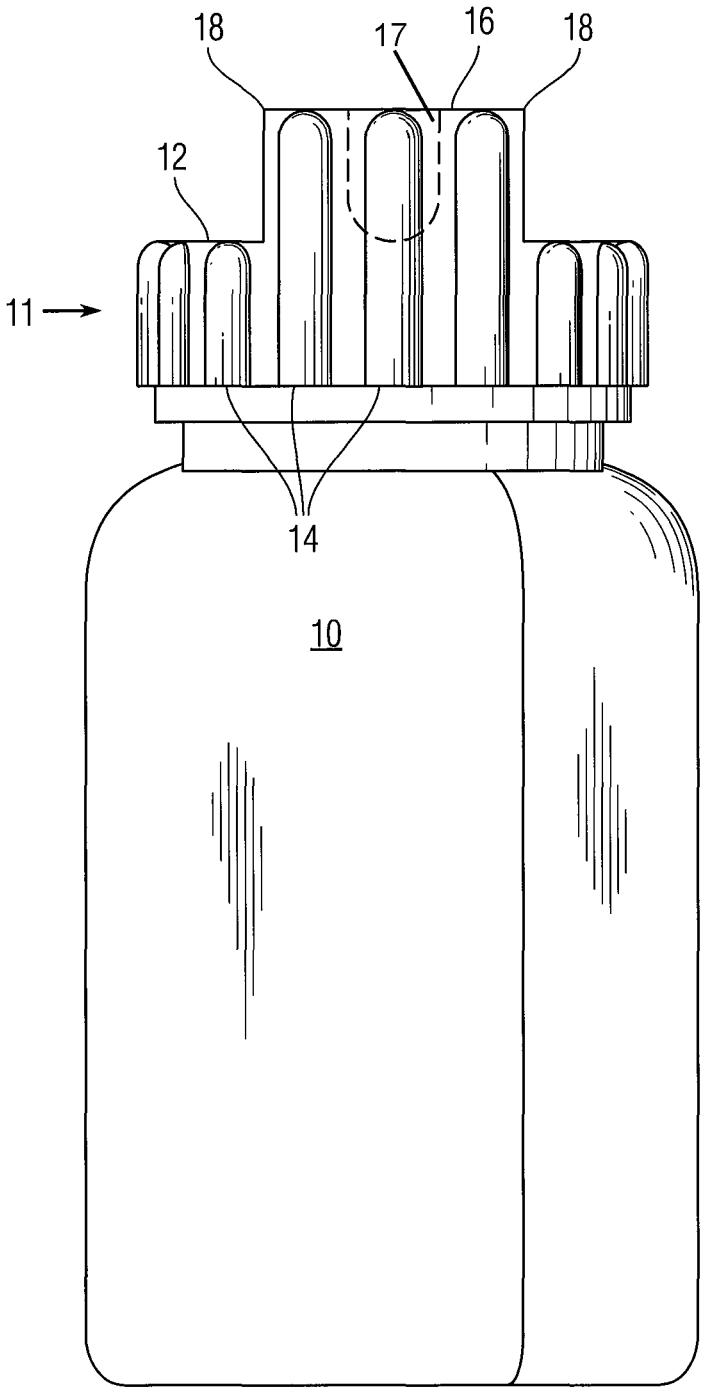
FIG. 3 is a right side elevation of the cap of the present invention mounted on a rectangular bottle.

As best seen in FIG. 2 the tabs make a 90 degree angle with the top surface of the cap. FIG. 3 shows that the top corners 18 of the tabs are squared (90 degree angles). However, this is not critical and a more rounded attachment would still work.

If desired the tabs and base of the cap may be provided with ribs 14 which aid in gripping the cap. The ribs may be of any convenient size and distribution. While helpful, the ribs are not essential to the invention.

The squared top corners 18 of the cap permit maximal surface for gripping a corner surface, and the right angle at the juncture of the tab and top surface of the cap minimize slipping of the cap off the corner surface while twisting the cap off of the bottle. Nevertheless, some rounding of the top corners is permitted without departing from the invention, so long as the tabs are sufficiently high at the ends of the tabs to create a secure grip on the corner.

The 1¼" separation of the two tabs permits the necessary distance for grabbing of a corner surface by the cap, especially for the many corner surfaces that are rounded. To the extent the cap is too small to permit this distance, it may be compensated by making the tabs higher, or create an extended platform on the surface of the cap from which the tabs can project upward (not shown).

As an alternative, the tabs can have a cutout 17 with a square shape, U-shape or V-shape, so that there are 4 tabs on the cap (shown in dotted line in FIG. 3). This allows some additional flexibility in the tabs that enhances their ability to grip a corner.

Figure 5:
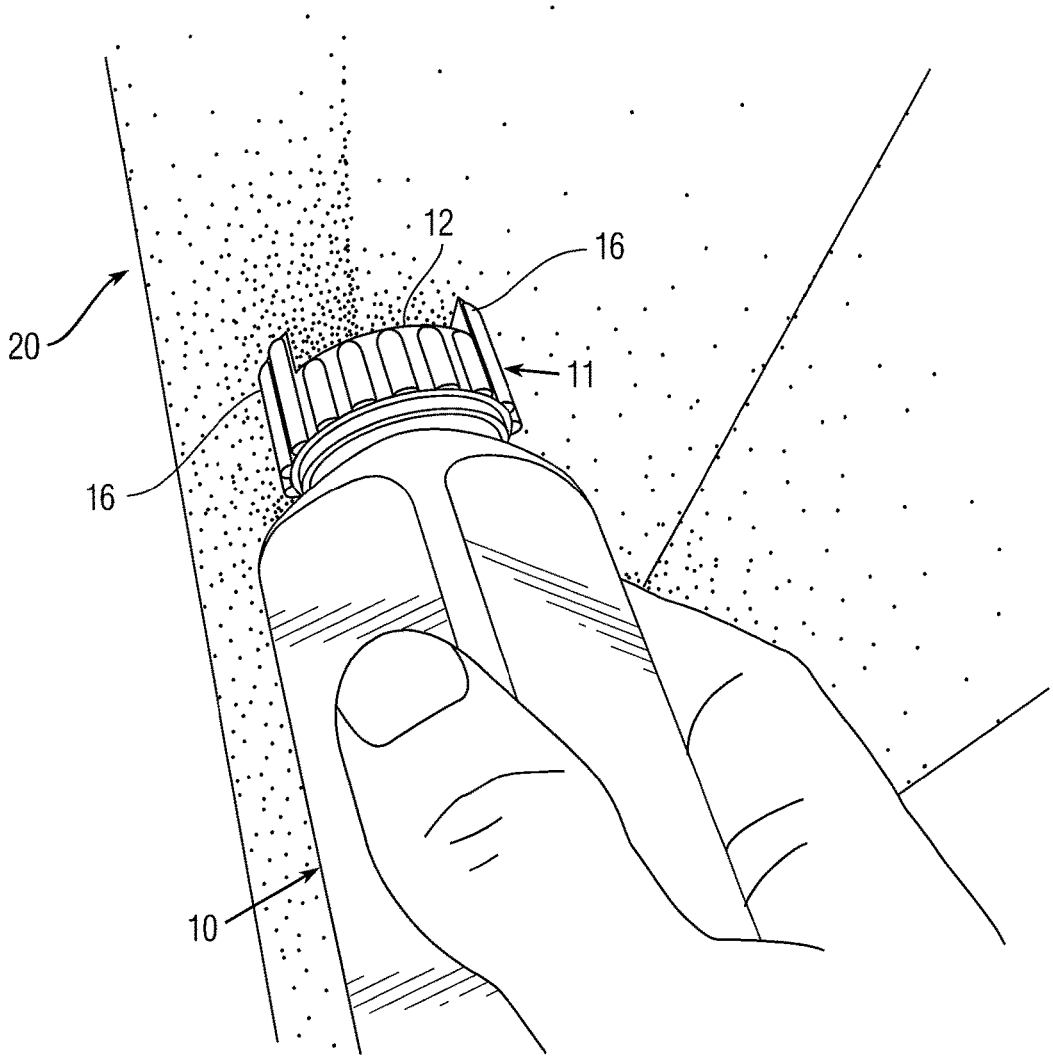
FIG. 5 is a perspective view of the cap of the present invention mounted on a bottle and engaging the corner of a piece of furniture as it is twisted to disengage it from the bottle.
Figure 6:
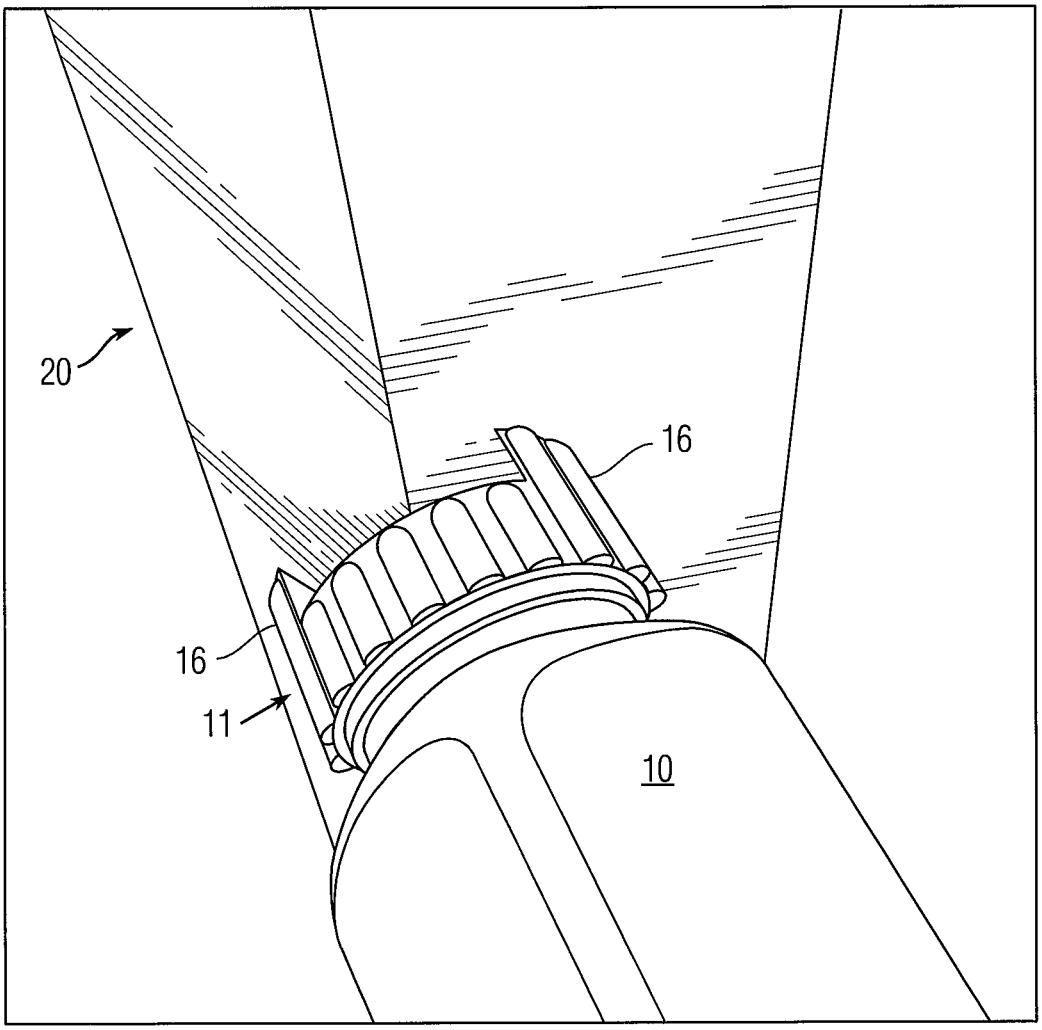
FIG. 6 is a perspective view of the cap of the present invention mounted on a bottle and engaging the corner of a door frame as it is twisted to disengage it from the bottle.
Figure 7:
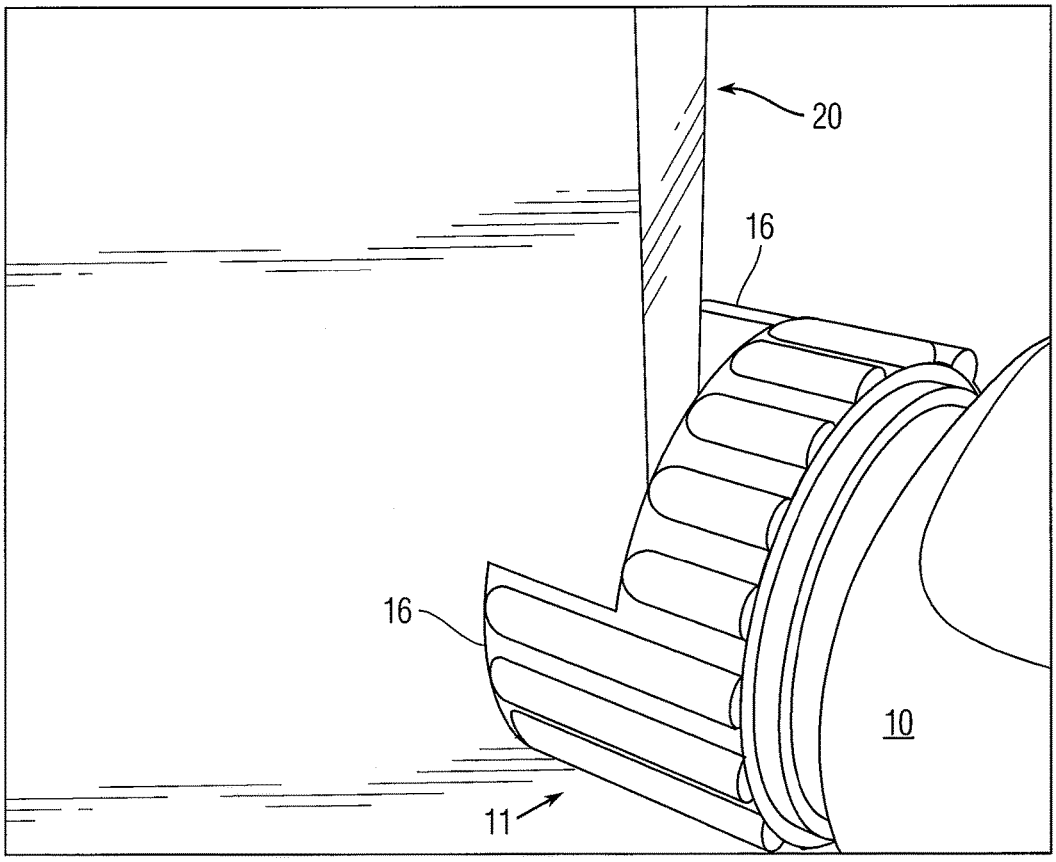
FIG. 7 is a perspective view of the cap of the present invention mounted on a bottle and engaging the corner of a shelf as it is twisted to disengage it from the bottle.
Figure 8:
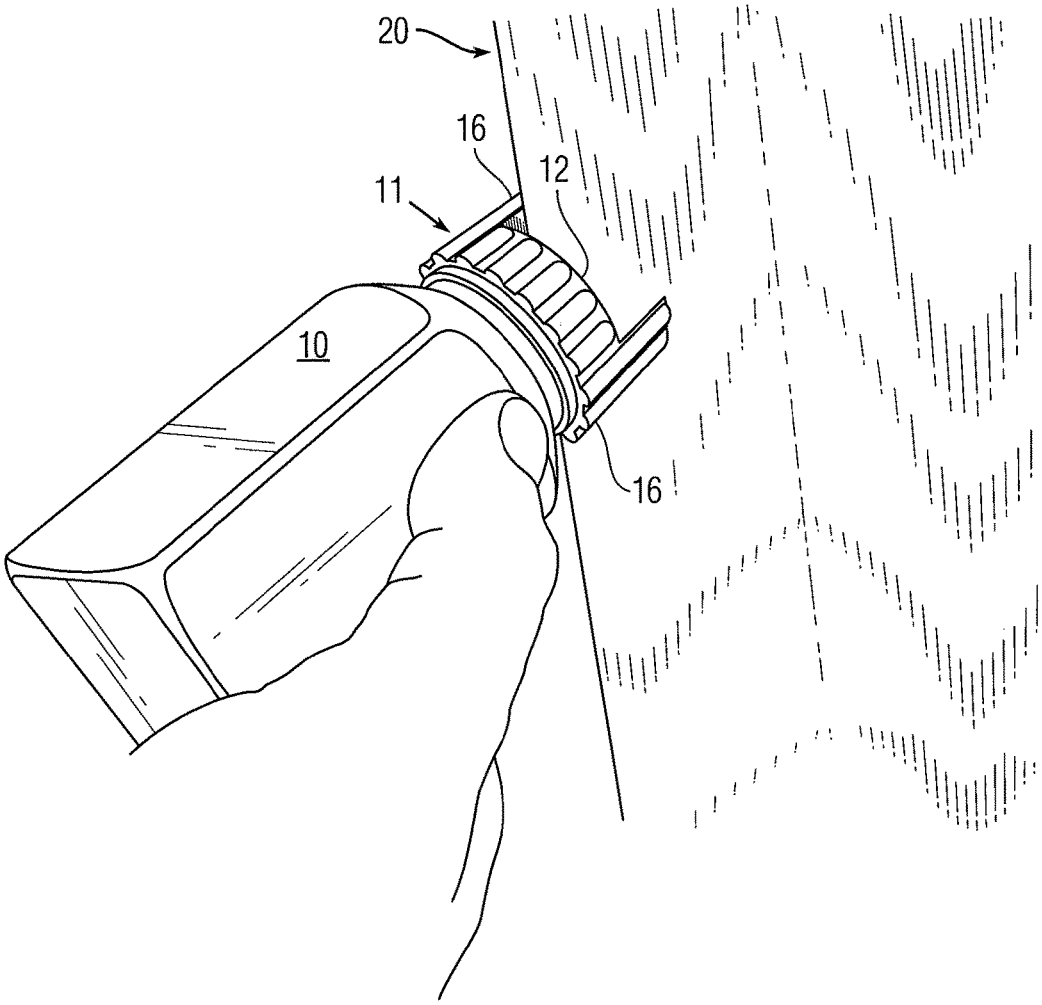
FIG. 8 is a perspective view of the cap of the present invention mounted on a bottle and engaging the corner of a desk as it is twisted to disengage it from the bottle.

In use the bottle 10 with the cap 11 is grasped by the user and is located so that the tabs 16 are on either side of a corner of some structure 20, e.g., furniture in FIG. 5. Then the user twists the bottle, which applies torque on the cap because the tabs cause it to resist turning with the bottle. The corner can be part of any convenient object or structure, e.g., a door frame as illustrated in FIG. 6, a shelf as illustrated in FIG. 7 or a desk as illustrated in FIG. 8. Typically a corner is selected so that the contents of the bottle do not fall or spill out while torque is applied to the cap. However, if sufficient threads are provided on the bottle and cap, torque can be applied to loosen the cap without the contents falling out. Then the bottle can be placed in an upright position and manually opened before the cap is sufficiently loosened to allow the contents to spill.

While the cap illustrated has a circular shape, the invention is not limited to such caps and may be used on square caps or caps with other configurations.

The present design with its square cornered tabs provides more gripping ability than the rounded tabs of the inventor's prior design patents or the "v"-shaped tabs of U.S. Pat. No. 4,731,512 of Barriac, which easily slip off from a corner surface while twisting the bottle. Further, it is an improvement over the Barriac tabs which are aligned with the center or midline of the cap and instead are arranged along its periphery. It also provides four points of contact with a corner, i.e., one at each edge of the two tabs, thus increasing the ability to grasp the corner.

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

I claim:

1. A twist closure for a container, the closure comprising:

a circular upper surface;

a depending perimeter side wall that extend completely around the upper surface from the upper surface to a bottom edge, said sidewall being directly engaged and disengaged from the container by a twisting force;

a first upstanding tab and a second upstanding tab spaced apart on the upper surface, said tabs having a generally rectangular shape and being arranged in parallel along the perimeter of the upper surface, said rectangular shapes of said tabs having flat top surfaces extending over the entire tab and generally parallel with the upper surface and flat inner surfaces facing each other on opposite sides of the upper surface, outer surfaces of the tabs being curved along the perimeter of the upper surface of the closure; said tabs being about ¼ inch in height or higher, have a thickness at their thickest point of about $\frac{1}{8}^{th}$ inch or more, and a length of about $\frac{7}{8}^{th}$ inch or more, the distance between the tabs being sufficient to promote gripping of a corner surface of a stationary object so as to allow a torque to be transferred to the closure by applying the twisting force to the container and being about 1 ¼ inches or more; and ribs located about the periphery of the closure to assist a user in gripping the cap, said ribs being generally parallel to each other and extend to the tops of the tabs where the tabs are located, said ribs having semi-circular tops and flat bottoms and extending all the way to the bottom edge of the cap.

2. The twist closure of claim 1 wherein the rectangular shapes of the tabs make four points of contact with the object to reduce the likelihood the tabs will slip off the corner of the stationary object.

3. The twist closure of claim 1 wherein the closure is a circular cap.

4. The twist closure of claim 1 wherein the tabs make a 90 degree angle with the upper surface.

5. The twist closure of claim 1 wherein the rectangular shapes have rounded corners at their tops.

6. The twist closure of claim 3 wherein the outer surface of the tabs follows the contour of the cap.

* * * * *